US008792665B2

(12) United States Patent
Lin

(10) Patent No.: US 8,792,665 B2
(45) Date of Patent: Jul. 29, 2014

(54) FOREIGN MATERIAL MITIGATION FOR HEARING ASSISTANCE DEVICE COMPONENTS

(75) Inventor: Wei Li Lin, Plymouth, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 212 days.

(21) Appl. No.: 12/980,672

(22) Filed: Dec. 29, 2010

(65) Prior Publication Data

US 2011/0182452 A1 Jul. 28, 2011

Related U.S. Application Data

(60) Provisional application No. 61/291,496, filed on Dec. 31, 2009.

(51) Int. Cl.
*H04R 25/00* (2006.01)

(52) U.S. Cl.
USPC ..... 381/325; 381/312

(58) Field of Classification Search
CPC ... H04R 25/60; H04R 25/654; H04R 2460/17
USPC ..... 381/325, 322, 330, 312; 181/129, 130, 181/131; 29/896.1
See application file for complete search history.

(56) References Cited

U.S. PATENT DOCUMENTS 4,879,750 A 11/1989 Nassler
4,987,597 A 1/1991 Haertl
6,068,911 A 5/2000 Shouji et al.
6,134,333 A * 10/2000 Flagler ..... 381/325
6,449,373 B2 * 9/2002 Baker ..... 381/325
6,671,381 B1 12/2003 Lux-Wellenhof
7,267,847 B2 9/2007 Karamuk (Continued)

FOREIGN PATENT DOCUMENTS

EP 1432281 A2 6/2004
EP 1432285 A2 6/2004

(Continued)

OTHER PUBLICATIONS

"European Application Serial No. 08252008.1, Extended European Search Report mailed Dec. 6, 2010", 10 Pgs.

(Continued)

*Primary Examiner* — Curtis Kuntz
*Assistant Examiner* — Sunita Joshi
(74) *Attorney, Agent, or Firm* — Schwegman, Lundberg & Woessner, P.A.

(57) ABSTRACT

Disclosed herein, among other things, are methods and apparatus for mitigating foreign material buildup for hearing assistance device components. The present subject matter includes coating of at least one surface of a hearing assistance device, such as a hearing aid, with an omniphobic coating, a hydrophilic coating, or a combination of omniphobic and hydrophilic coatings designed to reduce the unwanted effects of wax, moisture and other foreign materials. In various embodiments at least one surface of a receiver with a wax trap or waxceptor in a receiver tube is coated with an omniphobic coating. In various embodiments the present subject matter includes an internal barrier disposed near a receiver in the receiver tube in addition to the wax trap or waxceptor. In various embodiments the internal barrier is coated with an omniphobic coating. In various embodiments at least one surface includes a hydrophilic coating.

20 Claims, 4 Drawing Sheets

(56) References Cited

U.S. PATENT DOCUMENTS

| | | | | |
|---|---|---|---|---|
| 7,372,973 | B2 | 5/2008 | Meier | |
| 7,443,992 | B2 | 10/2008 | Fideler | |
| 7,499,561 | B2 | 3/2009 | Hanses et al. | |
| 7,551,747 | B2 | 6/2009 | Huynh et al. | |
| 2003/0196687 | A1 | 10/2003 | Campbell et al. | |
| 2004/0179709 | A1 | 9/2004 | Niederdraenk et al. | |
| 2005/0018866 | A1 | 1/2005 | Schulein et al. | |
| 2005/0141738 | A1 | 6/2005 | Karamuk | |
| 2007/0047752 | A1* | 3/2007 | Wagner et al. | 381/330 |
| 2008/0200779 | A1 | 8/2008 | Zimmerling et al. | |
| 2008/0240479 | A1 | 10/2008 | Linford et al. | |
| 2008/0310660 | A1 | 12/2008 | Lin | |
| 2009/0154747 | A1 | 6/2009 | Vestergaard et al. | |
| 2010/0322452 | A1 | 12/2010 | Ladabaum et al. | |
| 2012/0219167 | A1 | 8/2012 | Yoong et al. | |

FOREIGN PATENT DOCUMENTS

| | | | |
|---|---|---|---|
| EP | 1458217 | A2 | 9/2004 |
| EP | 2003929 | A2 | 12/2008 |
| EP | 2003931 | A2 | 12/2008 |
| JP | 61203800 | | 9/1986 |
| WO | WO-9312626 | A1 | 6/1993 |
| WO | WO-9948328 | A1 | 9/1999 |
| WO | WO-03094574 | A1 | 11/2003 |
| WO | WO-2004104116 | A1 | 12/2004 |
| WO | WO-2007005852 | A2 | 1/2007 |
| WO | WO-2007005866 | A2 | 1/2007 |
| WO | WO-2008025355 | A1 | 3/2008 |
| WO | WO-2008080397 | A1 | 7/2008 |
| WO | WO-2008154954 | A1 | 12/2008 |

OTHER PUBLICATIONS

"U.S. Appl. No. 12/138,267, Non Final Office Action mailed Jun. 30, 2011", 16 pgs.
"U.S. Appl. No. 12/138,267, Response filed Sep. 30, 2011 to Non-Final Office Action mailed Jun. 30, 2011", 11 pgs.
"European Application Serial No. 10252241.4; Search Report mailed Mar. 31, 2011", 7 Pgs.
U.S. Appl. No. 12/138,267 , Response filed Jan. 11, 2013 to Final Office Action mailed Oct. 11, 2012, 9 pgs.
U.S. Appl. No. 12/138,267 , Response filed Mar. 9, 2012 to Final Office Action mailed Dec. 9, 2011, 8 pgs.
U.S. Appl. No. 12/138,267 , Response filed Sep. 25, 2012 to Non Final Office Action mailed Apr. 25, 2012, 10 pgs.
U.S. Appl. No. 12/138,267, Advisory Action mailed Jan. 24, 2013, 3 pgs.
U.S. Appl. No. 12/138,267, Advisory Action mailed Mar. 21, 2012, 3 pgs.
U.S. Appl. No. 12/138,267, Final Office Action mailed Oct. 11, 2012, 17 pgs.
U.S. Appl. No. 12/138,267, Final Office Action mailed Dec. 9, 2011, 16 pgs.
U.S. Appl. No. 12/138,267, Non Final Office Action mailed Apr. 25, 2012, 16 pgs.
U.S. Appl. No. 13/404,496, Non Final Office Action mailed Apr. 16, 2013, 11 pgs.
European Application Serial No. 10252241.4, Extended Search Report Response filed Jan. 27, 2012, 11 pgs.
"U.S. Appl. No. 13/404,496, Final Office Action mailed Oct. 29, 2013", 14 pgs.
"U.S. Appl. No. 13/404,496, Preliminary Amendment mailed May 14, 2012", 3 pgs.
"U.S. Appl. No. 13/404,496, Response filed Jul. 16, 2013 to Non Final Office Action mailed Apr. 16, 2013", 8 pgs.
"U.S. Appl. No. 13/404,496, Advisory Action mailed Jan. 28, 2014", 3 pgs.
"U.S. Appl. No. 13/404,496, Non Final Office Action mailed Feb. 13, 2014", 16 pgs.
"U.S. Appl. No. 13/404,496, Response filed Jan. 29, 2014 to Advisory Action mailed Jan. 28, 2014 and Final Office Action mailed Oct. 29, 2013", 7 pgs.
"U.S. Appl. No. 13/404,496, Response filed Dec. 30, 2013 to Final Office Action mailed Oct. 29, 2013", 8 pgs.
"European Application Serial No. 10252241.4, Office Action mailed Dec. 18, 2013", 6 pgs.
"European Application Serial No. 12156939.6, Extended European Search Report mailed Feb. 11, 2014", 7 pgs.
Boersma, Paul, "Accurate Short-Term Analysis of the Fundamental Frequency and the Harmonics-to-Noise Ratio of a Sampled Sound", Institute of Phonetic Sciences, University of Amsterdam, Proceedings 17, (1993), 97-110.
Chou, Wen-Sheng, et al., "A binaural algorithm for space and pitch detection", 2011 IEEE International Conference on Acoustics, Speech and Signal Processing (ICASSP), (2011), 4976-4979.
Mitre, Adriano, et al., "Accurate and Efficient Fundamental Frequency Determination from Precise Partial Estimates", Proceedings of the 4th AES Brazil Conference, (2006), 113-118.
Noll, A. Michael, "Pitch Determination of Human Speech by the Harmonic Product Spectrum, the Harmonic Sum Spectrum and a Maximum Likelihood Estimate", Proceedings of the Symposium on Computer Processing in Communications, vol. XIX, Polytechnic Press: Brooklyn, New York, (1970), 779-797.

* cited by examiner

FOREIGN MATERIAL MITIGATION FOR HEARING ASSISTANCE DEVICE COMPONENTS

CLAIM OF PRIORITY

The present application claims the benefit under 35 U.S.C. §119(e) of U.S. Provisional Patent Application Ser. No. 61/291,496, filed on Dec. 31, 2009, which is incorporated herein by reference in its entirety.

FIELD OF THE INVENTION

The present subject matter relates generally to hearing assistance devices, and in particular to foreign material mitigation for hearing assistance device components.

BACKGROUND

One of the recurring problems with any body worn device having transducers is the accumulation of material that might block the proper operation of the transducer. Hearing assistance devices which are body worn and which have one or more transducers frequently encounter an accumulation of moisture, wax or other foreign material which can occlude apertures for the transducers and cause damage to the transducers eventually. One example of a hearing assistance device is a hearing aid. Hearing aids have apertures for reception of sound which can be blocked by moisture, wax or other material. Hearing aids may use protective screens, such as a wax guard, microphone cover, or other acoustic screens which are intended to reduce the amount of unwanted substances that can reach the transducer. However, occlusion and other effects of the buildup of wax, moisture and other materials continue to be an issue with such devices.

What is needed in the art is a way to provide enhanced protection against the buildup of wax, moisture or other materials on hearing assistance devices. Such method and apparatus should not only improve the longevity of the transducers, but also provide reduced occurrences of partial or full blockage of apertures used for sound reception by hearing assistance devices.

SUMMARY

Disclosed herein, among other things, are methods and apparatus for mitigating foreign material buildup for hearing assistance device components. The present subject matter includes coating of at least one surface of a hearing assistance device, such as a hearing aid, with an omniphobic coating, a hydrophilic coating, or a combination of omniphobic and hydrophilic coatings designed to reduce the unwanted effects of wax, moisture and other foreign materials. In various embodiments at least one surface of a receiver with a wax trap or waxceptor in a receiver tube is coated with an omniphobic coating. In various embodiments the present subject matter includes an internal barrier disposed near a receiver in the receiver tube in addition to the wax trap or waxceptor. In various embodiments the internal barrier is coated with an omniphobic coating. In various embodiments at least one surface includes a hydrophilic coating.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
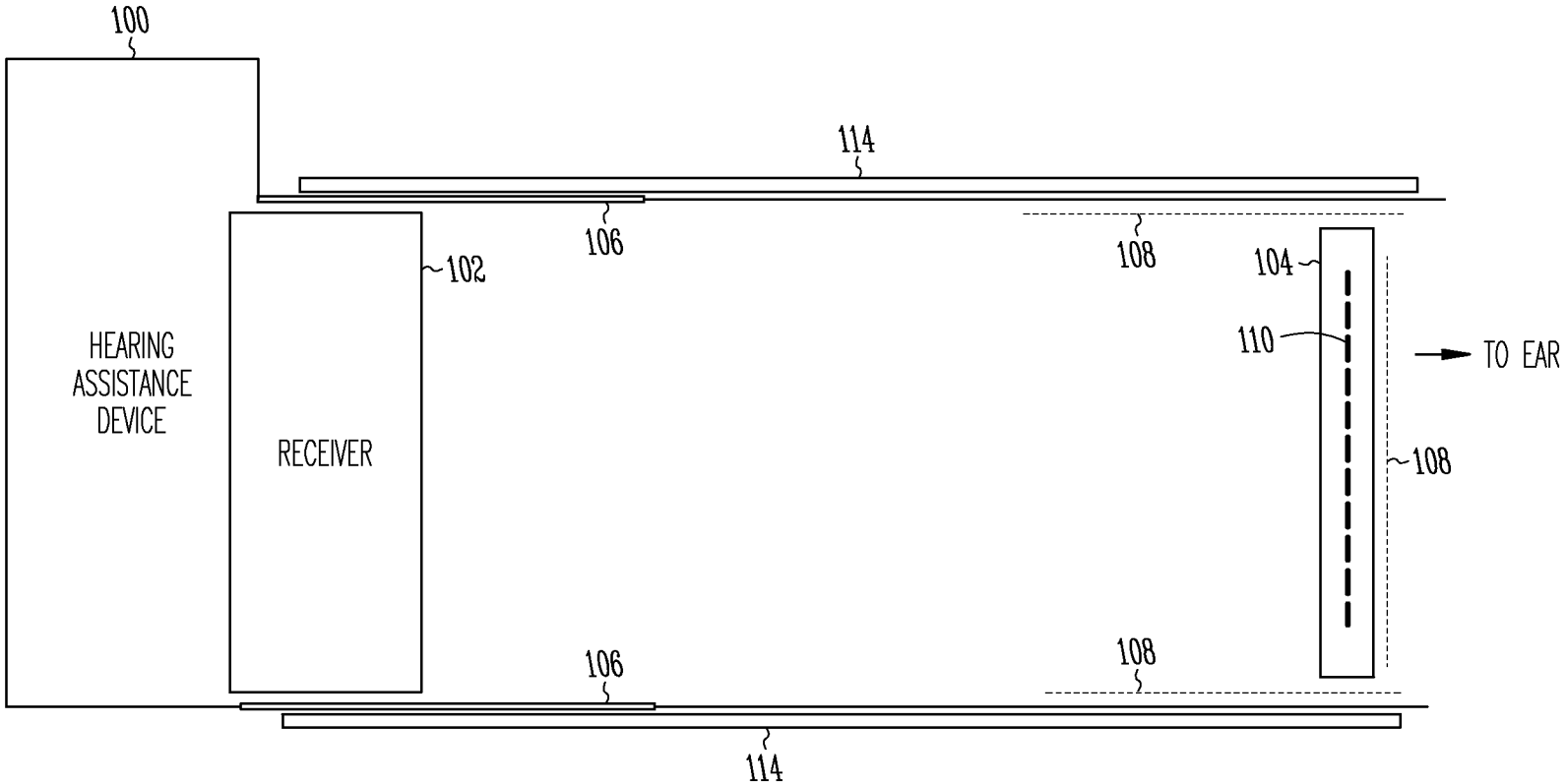
FIG. 1A shows an example of coated portions of a hearing assistance device according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter includes method and apparatus using a combination of omniphobic and hydrophilic coatings for a hearing assistance device. The following examples will be provided for a hearing aid, which is only one type of hearing assistance device. It is understood however, that the disclosure is not limited to hearing aids and that the teachings provided herein can be applied to a variety of hearing assistance devices.

In the example of a hearing aid, several embodiments are provided in which a combination of omniphobic and hydrophilic coatings are used to reduce the effects of wax, moisture, and other unwanted substances. The present subject matter is demonstrated for hearing assistance devices, including hearing aids, including but not limited to, behind-the-ear (BTE), in-the-ear (ITE), in-the-canal (ITC), receiver-in-canal (RIC) or receiver-in-the-ear (RITE), and completely-in-the-canal (CIC) type hearing aids.

An omniphobic coating protects hearing assistance devices from earwax and oily foreign material in addition to moisture and sweat. The omniphobic coating presents both superhydrophobic and oleophobic characteristics, according to various embodiments. Oleophobic refers to the physical property of a surface that is repellent from oil. Superhydrophobic phenomenon can be found in many plants, such as lotus leaves, which have leaves with a superhydrophobic surface as the basis of a self-cleaning mechanism. In this case, water droplets completely roll off the leaves and carry the dirt and mud with them at the same time. This self-cleaning or lotus effect is caused by both the hierarchical roughness of the leaf surface (composed of micrometer sized papillae), and the intrinsic hydrophobicity of a surface layer covering these papillae. The roughness enhances the natural non-wetting nature of the surface, leading to very large contact angles (150° or higher) for a liquid drop on the surface. Surface contact angles have been used to define hydrophobicity, superhydrophobicity, and oleophobicity. For example, a water droplet spreads further on a surface with a hydrophobic coating, producing a water contact angle (WCA) between about 90° and 150°. The WCA for a surface with a superhydrophobic coating is greater than about 150°.

A test on fluid droplets placed on an untreated acoustic mesh and on an acoustic mesh treated with an omniphobic coating was performed. After a delay (for example, ten minutes), the untreated acoustic mesh has permitted the fluid droplet to penetrate the mesh to a much greater extent than the mesh treated with the omniphobic coating. Omniphobicity can be achieved by introducing textures on the surface of interest at nano scale (such as nano tube forest, nano particles, or etching) through photochemical treatment. One example of the surface texturing uses a feature height of about 10 nanometers to 1 micrometer to make it difficult for moisture and wax to accumulate on the surface without rolling off. There are additional sources and processes for omniphobic coating to those mentioned herein, which are intended to demonstrate ways of making and using the present subject matter and are not intended in an exclusive or exhaustive sense.

The present subject matter relates to various approaches for treating hearing aid components and critical areas with nanocoating to mitigate foreign material. The effectiveness of repellent nanocoating on the exterior of a hearing device can degrade significantly over time. As a result, it is important to achieve uniform coating coverage in other crucial areas that may not suffer from the same daily abuse. By strategically applying omniphobic and hydrophilic nanocoatings in crucial areas and components of hearing instruments, the longevity of these devices can be substantially improved.

The following areas are important to the longevity of hearing instruments in the field:

- Acoustic paths/channels:
  - Covers used to protect acoustic ports, such as microphone cover and wax guard;
  - The conduit connecting a port of a hearing aid to the corresponding transducer (microphone/receiver), such as a receiver tube;
  - Earhook and associated acoustic damper for a BTE device;
- The ports/inlets of electro-acoustic transducers;
- The interior areas:
  - Areas surrounding electrical components and their connections;
  - Internal surface areas of the case and spine
- User interface components such as switch/push button;
- Battery compartment;
- Other components prone to damage from foreign material exposure, such as elastomeric or rubber pieces used for transducer suspension and/or seal.

Figure 1B:
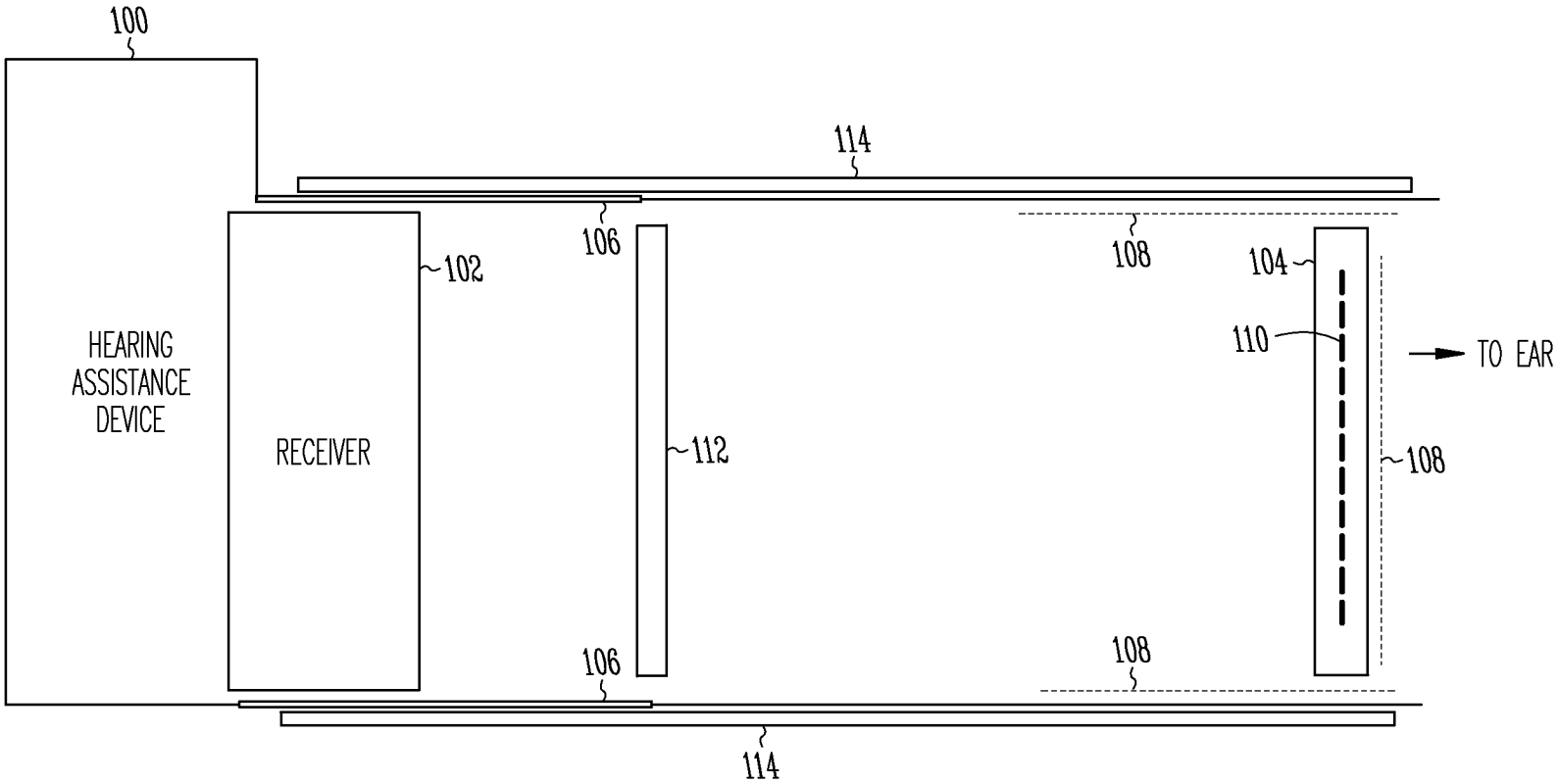
FIG. 1B shows an example of coated portions of a hearing assistance device according to various embodiments of the present subject matter.

According to various embodiments, nanocoating with desirable characteristics can be applied strategically in the above mentioned areas. FIG. 1A shows an example of coated portions of a hearing assistance device 100, such as a hearing aid, according to various embodiments of the present subject matter. In one embodiment, in order to mitigate the damage to receiver due to earwax, omniphobic coating 108 can be applied on the exterior of a wax guard 104 and its associated barrier structure, such as an attached mesh, the inner surface of the receiver tube 114, and the spout 106 of the receiver 102. In various embodiments hydrophilic coating 110 is applied on the interior of the wax guard 104, which can be used to promote wax absorption further away from the receiver 102. In various embodiments, a small pocket and side slit is disposed between the wax guard and receiver tube for absorbed wax to exit upon exposure to elevated temperature, such as through a dehumidifier. As shown in FIG. 1B, in various embodiments another barrier 112 is added near the receiver inlet. In various embodiments omniphobic, hydrophilic or combinations of omniphobic and hydrophilic coatings can be applied to any surface of the hearing assistance device and its components. The coatings shown in the figures demonstrate only some coated surfaces and are not an exhaustive representation of the surfaces coated in various embodiments of the present subject matter. It is understood that other surfaces may be coated in various applications of the present teachings without departing from the scope of the present subject matter.

Figure 3:
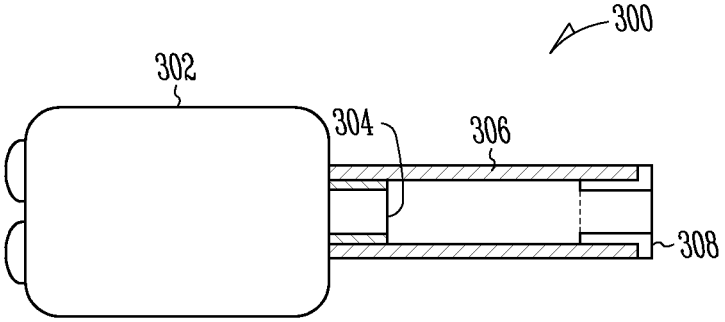
FIG. 3 shows an apparatus adapted to reduce migration of unwanted material in a receiver assembly according to various embodiments of the present subject matter.

FIG. 3 shows an apparatus adapted to reduce migration of unwanted material in a receiver assembly 300 according to various embodiments of the present subject matter. The receiver assembly 300 includes a receiver 302 with a spout 304 and a wax guard 308 disposed at an end of the receiver tube 306. The wax guard 308 (also known as a wax trap or a waxceptor) has a plurality of small openings that are acoustically transparent. The wax guard 308 is treated with an omniphobic coating to reduce adhesion to the ear wax; however, wax may enter the receiver tube due to force, such as insertion of the device. Gravity causes the wax to move to the receiver inlet. An omniphobic coating can be applied in various embodiments to the receiver tube 306 and/or the receiver spout 304 to repel oily wax. The repulsion will be especially significant upon heating the area. If the device is turned upside down, gravity will allow the wax to flow out of it. In various embodiments, a hydrophilic coating can be applied to absorb wax along its path.

Figure 4:
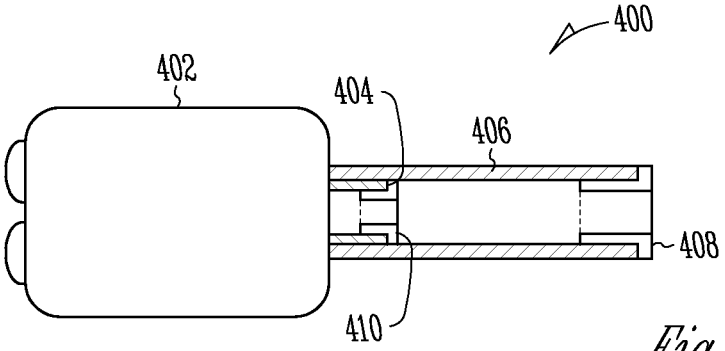
FIG. 4 shows an apparatus adapted to reduce migration of unwanted material in a receiver assembly according to various embodiments of the present subject matter.

FIG. 4 shows an apparatus adapted to reduce migration of unwanted material in a receiver assembly 400 according to various embodiments of the present subject matter. The receiver assembly 400 includes a receiver 402 with a spout 404 and a wax guard 408 disposed at an end of the receiver tube 406. The wax guard 408 (also known as a wax trap or a waxceptor) has a plurality of small openings that are acoustically transparent. The wax guard 408 is treated with an omniphobic coating to reduce adhesion to the wax guard. An internal barrier 410 is attached to the receiver spout area which will deter wax from entering the receiver due to a lack of applied force at the internal barrier 410. An omniphobic coating can be applied to the internal barrier 410, and in various embodiments to the receiver tube 406 and/or the receiver spout 404 to repel oily wax. The repulsion will be especially significant upon heating the area. If the device is turned upside down, gravity will allow the wax to flow out of it. In various embodiments, a hydrophilic coating can be applied to absorb wax along its path.

Figure 5:
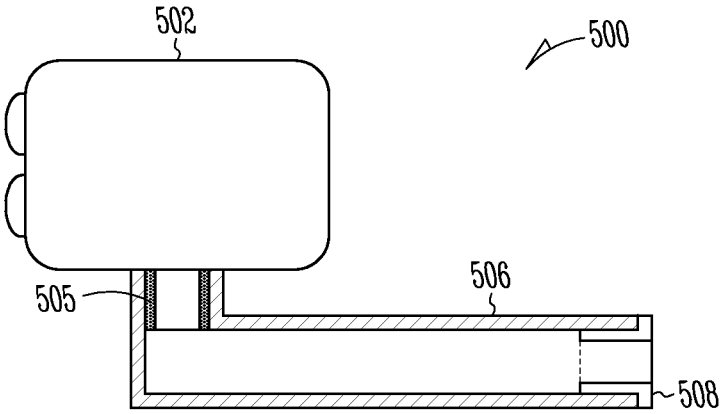
FIG. 5 shows an apparatus with an angled receiver tube adapted to reduce migration of unwanted material in a receiver assembly according to various embodiments of the present subject matter.

FIG. 5 shows an apparatus with an angled receiver tube adapted to reduce migration of unwanted material in a receiver assembly 500 according to various embodiments of the present subject matter. The receiver assembly 500 includes a receiver 502 with a spout 504 and a wax guard 508 disposed at an end of the receiver tube 506. The wax guard 508 (also known as a wax trap or a waxceptor) has a plurality of small openings that are acoustically transparent. The wax guard 508 is treated with an omniphobic coating to reduce adhesion to the wax guard 508. In various embodiments an optional internal barrier similar to that shown in FIG. 4 is attached to the receiver spout area which will deter wax from entering the receiver due to a lack of applied force at the internal barrier. In various embodiments, an omniphobic coating can be applied to the internal barrier, to the receiver tube 506 and/or the receiver spout 504 to repel oily wax. The angled receiver tube 506 takes advantage of gravity to prevent wax from entering the receiver 502 or its inlet. In various embodiments this can also be achieved through an internal channel between the spout and inlet. In various embodiments, a hydrophilic coating can be applied to absorb wax along its path.

Figure 2:
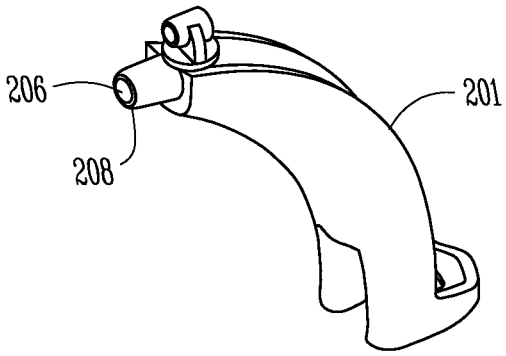
FIG. 2 shows an example of a behind-the-ear device with coated portions, according to various embodiments of the present subject matter.

FIG. 2 shows an example of a behind-the-ear device 201 with coated portions, according to various embodiments of the present subject matter. An omniphobic coating 208 is applied on the spout 206 of the device, which leads to the receiver inlet. In various embodiments this technique is applied to an ear bud for RIC devices. In this embodiment, the exterior of the ear bud is treated with omniphobic coating to repel the wax, whereas the "finger" areas can be treated with hydrophilic coating to direct excessive wax further away from the acoustic port.

A similar approach can be employed to protect a microphone from foreign material. In this embodiment, omniphobic coating can be applied to the exterior of a microphone cover and its associated acoustic mesh, the surface of the path from the microphone cover to the microphone, and the microphone inlet. In addition, hydrophilic coating can be applied around the side of the microphone cover and portion of the case to reduce the likelihood of material accumulation on the microphone cover and port(s).

In another embodiment, an acoustic resistance medium (including, but not limited to, mesh or foam) treated with omniphobic coating can be used in place of a traditional damper, which could be clogged by foreign substances rather easily. An omniphobic coating can then be applied to the exterior of an ear hook and sound tube through surface treatment. In addition, at certain sections of the ear hook, hydrophilic material can be deployed to absorb excess moisture. By using this technique, it is expected that the acoustic path through the earhook should be less prone to the impact of high humidity and sweat environment, and the omniphobic-treated acoustic damper should retain its functionality much longer than the traditional damper.

In various embodiments, an omniphobic coating is applied on the exterior and along the case seams to repel moisture. In addition, hydrophilic coating is applied at the interior surface around the seams to absorb residual moisture. The added benefit is that upon absorption, the hydrophilic coating can expand its volume significantly (in some cases by a factor of ten) so that the seams can be sealed off until the absorbed moisture is released.

According to an embodiment, an omniphobic coating is applied to a flex circuit and conductive traces in place of conformal coating to provide more uniform coverage and better protection from moisture ingress. Certain elastomeric materials tend to degrade from the exposure to oily substances such as earwax and lotion; this can be remedied by treating them with omniphobic coating. In one embodiment, omniphobic coating is applied around the joints of a transducer pair and/or a critical bonding surface to provide necessary protection from moisture, since the glue used to bond them could lose its effectiveness after being exposed to sweat and salt. Similarly, for RIC applications, treatment with omniphobic coating around the mating harness between a receiver tube and the RIC case, through either hard wired or a conductive elastomeric connection, improves its robustness significantly.

The coatings are made in areas which will resist wax, moisture, and other unwanted materials. In one embodiment, the coatings are made in the port region near a microphone. In multi-microphone embodiments, the coatings may be on all or some of the port regions of a hearing assistance device. The coatings may be small enough not to interfere with fit of the components and may be in an area where the coatings will not be damaged in either assembly or use.

The benefits of repellent nanocoating have been demonstrated in various experiments. For instance, it was found that hearing aids fabricated without using conformal coating, but were treated with omniphobic hydrophobic nanocoating, showed no circuit related issues after salt fog experiments. It was also found that the microphone pairs (composed of Omni and Directional capsules) treated with omniphobic coating retained its bonding after salt fog, whereas untreated ones separated afterwards. In the case of a capacitive switch, it was found that water tight seal around the sensor was critical to maintain the switch performance under moist conditions. It was confirmed that omniphobic coating improved the robustness of the switch dramatically after a salt fog experiment. Benefits of the present subject matter include improved hearing assistance device longevity and product quality, and reduced maintenance costs.

Thus, several approaches and combinations of omniphobic and/or hydrophilic coatings can be performed to migrate foreign material in such devices. The examples provided herein are not intended in an exclusive or exhaustive sense.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device configured to resist accumulation of foreign materials, the device comprising:

an acoustic port;

a transducer;

an acoustic path or channel, the acoustic path or channel including a conduit connecting the acoustic port to the transducer, the conduit having an inner surface;

a cover in the acoustic path or channel, the cover configured to protect the acoustic port and including an exterior area and an interior area;

a first surface coated with an omniphobic coating including superhydrophobic and oleophobic properties, the first surface including an area on the inner surface of the conduit and the exterior area of the cover; and a second surface coated with a hydrophilic coating, the second surface including the interior area of the cover.

2. The device of claim 1, wherein the omniphobic coating and the hydrophilic coating comprise surface textures having a feature height of about 10 nanometers to 1 micrometers.

3. The device of claim 1, wherein the conduit comprises a receiver tube including the first surface.

4. The device of claim 1, wherein the transducer comprises a microphone.

5. The device of claim 1, wherein the transducer comprises a receiver.

6. The device of claim 1, wherein at least one of the first surface and the second surface comprises an area in the acoustic port.

7. A hearing assistance device configured to mitigate accumulation of wax, the device comprising:

a receiver;

a receiver tube having an inner surface;

an omniphobic coating applied to the inner surface of the receiver tube to repel the wax, the omniphobic coating including superhydrophobic and oleophobic properties;

a path allowing the repelled wax to flow out of the device due to gravity; and a hydrophilic coating applied to the path to absorb the repelled wax.

8. The device of claim 7, comprising a wax guard having an exterior and an interior, wherein the omniphobic coating is further applied the exterior of the wax guard.

9. The device of claim 8, comprising a hydrophilic coating applied to the interior of the wax guard.

10. The device of claim 9, further comprising a receiver spout and an interior barrier attached to the receiver spout, wherein the omniphobic coating is further applied at least one of the receiver spout and the interior barrier.

11. The device of claim 9, wherein the receiver tube is angled to prevent wax from entering the receiver or an inlet of the receiver using gravity during use.

12. A method for mitigating foreign material accumulation for a hearing assistance device, comprising:

repelling wax in the hearing assistance device using an omniphobic coating applied to a first area on an inner surface of a conduit of an acoustic path or channel of the hearing assistance device, the omniphobic coating including superhydrophobic and oleophobic properties; and absorbing the wax flowing out of the hearing assistance device through a flow path due to gravity using a hydrophilic coating applied to a second area of the acoustic path or channel, the second area being along the flow path.

13. The method of claim 12, wherein repelling the wax comprises heating the first area.

14. The method of claim 13, comprising turning the hearing assistance device to allow the wax to flow out of the hearing assistance device through the flow path due to gravity.

15. The method of claim 13, comprising applying the omniphobic coating, including introducing textures on a surface of the first area through photochemical treatment.

16. The method of claim 15, wherein applying the omniphobic coating comprises introducing the textures having a feature height of about 10 nanometers to 1 micrometer.

17. The method of claim 16, wherein applying the omniphobic coating comprises applying the omniphobic coating to interior areas of the hearing assistance device.

18. The method of claim 16, wherein applying the omniphobic coating further comprises applying the omniphobic coating to an area in user interface components of the hearing assistance device.

19. The method of claim 16, wherein applying the omniphobic coating further comprises applying the omniphobic coating to an area in a battery compartment of the hearing assistance device.

20. The method of claim 16, wherein applying the omniphobic coating further comprises applying the omniphobic coating to an area in elastomer or rubber components of the hearing assistance device.

* * * * *